US007014042B2

(12) United States Patent
Lane

(10) Patent No.: US 7,014,042 B2
(45) Date of Patent: Mar. 21, 2006

(54) FOLD OVER DISPLAY CASE WITH FASTENER

(75) Inventor: Henry Welling Lane, San Luis Obispo, CA (US)

(73) Assignee: Dioptics Medical Products, Inc., San Luis Obispo, CA (US)

( * ) Notice: Subject to any disclaimer, the term of this patent is extended or adjusted under 35 U.S.C. 154(b) by 124 days.

(21) Appl. No.: 10/656,064

(22) Filed: Sep. 5, 2003

(65) Prior Publication Data

US 2004/0093774 A1 May 20, 2004

Related U.S. Application Data

(60) Provisional application No. 60/409,405, filed on Sep. 9, 2002.

(51) Int. Cl.
*B65D 73/00* (2006.01)

(52) U.S. Cl. ..... 206/467; 206/5; 206/470; 206/806; 40/124.06

(58) Field of Classification Search ..... 206/5, 206/6, 232, 806, 461–464, 467, 470, 459.5, 206/477, 478, 1.5; 40/299.01, 124.06, 124.01; D3/265; 24/3.7, 3.8, 324
See application file for complete search history.

(56) References Cited

U.S. PATENT DOCUMENTS

| | | | |
|---|---|---|---|
| 296,993 | A | 4/1884 | Mopply |
| D74,101 | S | 12/1927 | Day |
| D113,402 | S | 2/1939 | Schram |
| D128,446 | S | 7/1941 | Franklin |
| D146,223 | S | 1/1947 | Kalintz et al. |
| D158,670 | S | 5/1950 | Klien |
| 2,738,054 | A | 3/1956 | Baratelli |
| D189,994 | S | 3/1961 | Speilberg |
| 3,000,417 | A | 9/1961 | Goldstein |
| 3,250,387 | A | 5/1966 | Jacobson et al. |
| 3,273,702 | A | 9/1966 | Palmer |
| 3,608,705 | A | 9/1971 | Moshel |
| 4,291,807 | A | 9/1981 | Giordano et al. |
| 4,360,106 | A | 11/1982 | Irvine et al. |
| 4,456,124 | A | 6/1984 | Kay et al. |
| 4,469,226 | A | 9/1984 | Matney |
| D282,718 | S | 2/1986 | Fireman |
| D293,389 | S | 12/1987 | Vitaloni |
| 4,733,775 | A | 3/1988 | Fireman |
| 4,823,943 | A | 4/1989 | Chang |
| D308,598 | S | 6/1990 | Burchett |
| D308,755 | S | 6/1990 | Chang |
| D346,815 | S | 5/1994 | Wake |
| D349,403 | S | 8/1994 | Cereda |

(Continued)

*Primary Examiner*—Mickey Yu
*Assistant Examiner*—Jerrold Johnson
(74) *Attorney, Agent, or Firm*—Derek J. Westberg

(57) ABSTRACT

A display apparatus for displaying a clip-on sunglass, sunglass or other product and a method of assembling the display apparatus. In one embodiment, a closable case is removably attached to a product card, wherein the product card includes product information and an aperture for handing the display apparatus on a display case. The closable case may be closable and removably attached to the product card with a fastener, wherein one portion of the fastener is mounted to the body of the closable case, while the other portion is mounted to the body of the closable case and to a perforated portion of the product card, thus allowing the closable case to be removed from the product card and used as a case for clip-ons, sunglasses or any other product.

26 Claims, 3 Drawing Sheets

U.S. PATENT DOCUMENTS

| | | | |
|---|---|---|---|
| D364,561 | S | 11/1995 | Champman et al. |
| 5,493,349 | A | 2/1996 | Barhydt et al. |
| 5,501,321 | A | 3/1996 | Liu |
| 5,617,948 | A | 4/1997 | Rainey |
| D382,475 | S | 8/1997 | Cooper |
| D406,460 | S | 3/1999 | Newcomer |
| D411,347 | S | 6/1999 | Newcomer |
| D412,059 | S | 7/1999 | White et al. |
| 6,003,663 | A | 12/1999 | Newcomer |
| 6,003,672 | A | 12/1999 | Chapman et al. |
| 6,047,883 | A | 4/2000 | Calvert et al. |
| 6,273,375 | B1 | 8/2001 | Knepp et al. |
| D484,692 | S | 1/2004 | Lane |

FOLD OVER DISPLAY CASE WITH FASTENER

RELATED APPLICATION(S)

This patent Application claims priority under 35 U.S.C. § 119(c) of the co-pending, co-owned U.S. Provisional Patent Application Ser. No. 60/409,405, filed Sep. 9, 2002, and entitled, "FOLD OVER CASE WITH SNAP." The U.S. Provisional Patent Application Ser. No. 60/409,405, filed Sep. 9, 2002, and entitled "FOLD OVER CASE WITH SNAP" is also hereby incorporated by reference in its entirety.

FIELD OF THE INVENTION

The invention relates to the field of cases, especially to display cases for eyewear, including sunglasses and clip-on sunglasses, and methods of assembling the same.

BACKGROUND OF THE INVENTION

Clip-on sunglasses are sunglass lenses having a frame structure with no temple pieces. Instead of the temple pieces, clip-ons have clips or clasps that allow a wearer to attach the clip-ons to an existing pair of eyeglasses. Clip-ons can be packaged in a number of ways. Typically, a soft case much larger than the clip-on is fashioned to not only hold the clip-on but also to hold a product card including the product information, trademarks and other consumer information. The problem with this packaging type is that the soft case is usually discarded with the product card after purchase, because the size of the product card requires the manufacturer to create a soft case that is much larger than the clip-ons. Such a soft case has no utility after the product card is removed because it is usually too large to conveniently use as a permanent clip-on case. Similar problems exist with cases for ordinary sunglasses as well.

What is needed is an improved case for display of eyewear and the like. It is toward these ends that the present invention is directed.

SUMMARY OF THE INVENTION

The invention provides a display apparatus for displaying a clip-on sunglass, sunglass or other product and a method of assembling the display apparatus. In one embodiment, the present invention is a display apparatus including a product card and a case that is closable with a fastener (e.g., a snap). The product card is removably attached to the case. In another embodiment, a method of assembling a display apparatus is provided in which a case that is closable with a fastener is assembled and a product card is removably attached to the case.

The fastener may include a first portion coupled to a stationary portion of the case and a second portion coupled to a closable portion of the case. The closable portion of the case may include a flexible flap. The product card may include an area defined by a perforation. The product card may be removably attached to the case by the case being coupled to the perforated area of the product card, such that the area defined by the perforation is removed from the product card when the case is removed from the product card. The case may be coupled to the perforated area of the product card by the fastener. The product card may include an aperture to allow the product card to be hung for display. Printed matter may appear on the product card.

The case may include a transparent flexible film from which the closable portion is formed and a rigid frame for inhibiting collapse of the case. The transparent flexible film may be wrapped around the rigid frame. The rigid frame may include end portions of the case and may also include a spanning member for holding the end portions in fixed positions with respect to one another. The rigid frame may include a nose piece portion for positioning eyewear within the case.

These and other aspects of the invention are described in more detail herein.

DETAILED DESCRIPTION OF THE PRESENT INVENTION

The invention provides a display apparatus for displaying a clip-on sunglass, sunglass or other product and a method of assembling the display apparatus. While the description herein is primarily directed to a case for a eyewear, such as a clip-on sunglass or other sunglass, such a case may hold other eyewear products or products unrelated to eyewear. A product card is removably attached to the display case. The apparatus, along with its contents, may be presented for sale. A consumer having purchased the apparatus may then remove the product card from the case and utilize the case for eyewear or any other product. The case may be made of a flexible material, a rigid material, a transparent material, an opaque material or any combination thereof.

The case is closable with a snap or other fastener. One portion of the fastener is coupled to the closable portion of the case (e.g., a lid or flap) may be a two-part clam shell type design. The clam shell is closed over the closable portion of the case and the product card. By perforating the product card, the case may be easily removed form the product card by pulling the case off the product card, thus breaking the perforation and leaving a small portion of the product card with the fastener. Preferably, though not necessarily, the perforation extends all the way through the product card. The case may also be removably attached to the product card using other means including adhesive, a hook and loop fastener, such as Velcro, or one or more studs or rivets (which may be metal or plastic), and may include a combination of two or more attaching means. Further, the case can be closed by folding an outside flap over the product. The case preferably also includes a rigid frame which may help to protect the product from being crushed. The following description and described figures depict a preferred, as well as other alternative embodiments of the present invention, and is not intended to be limiting. For example, other sizes and shapes of display cases may be constructed in accordance with the teachings herein.

Figure 1:
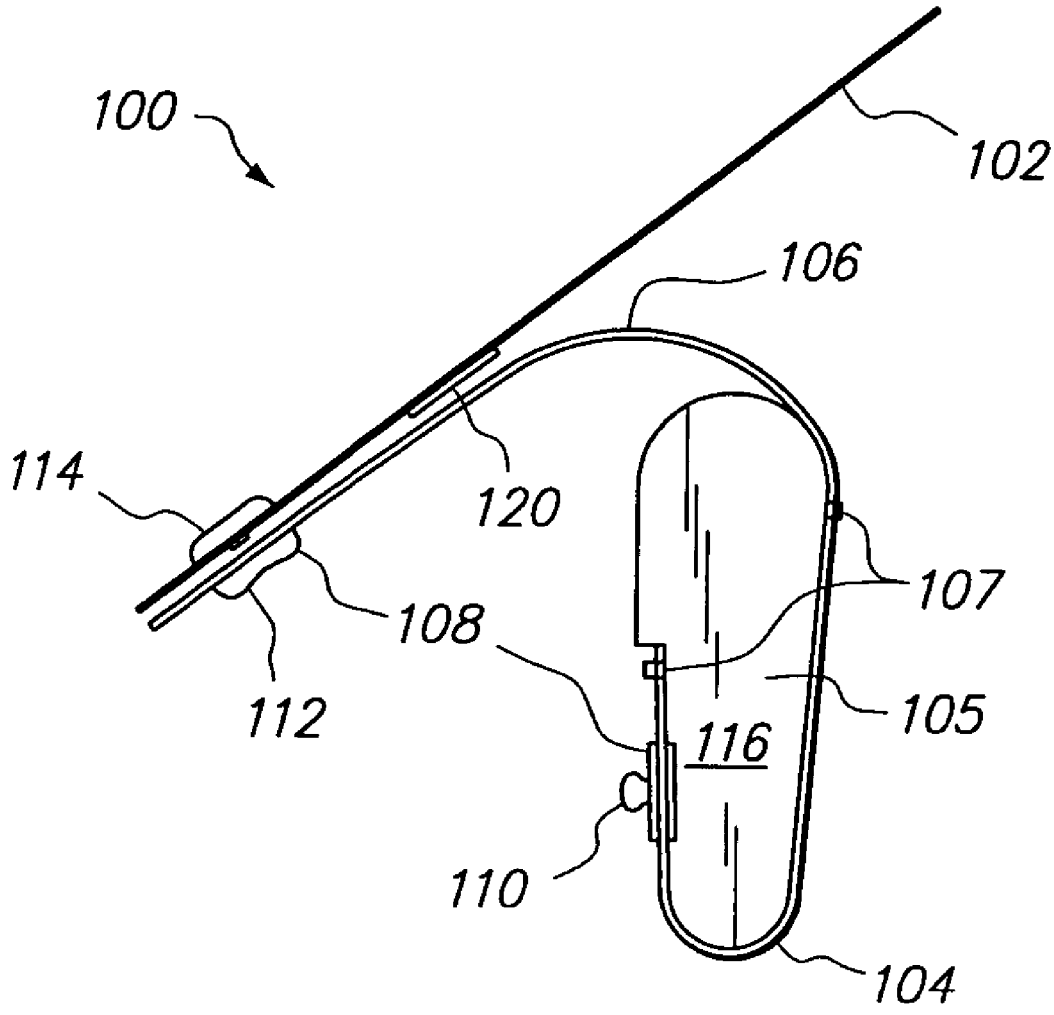
FIG. 1 illustrates a side view of an embodiment of the present invention.

FIG. 1 depicts a side view of an embodiment of the present invention. The display apparatus 100 includes both a product card 102 and a closable case 104. The closable case 104 has a case frame 105 that forms the ends 116 (FIGS. 2A and 2B) of the closable case 104 and may also form the bottom of the closable case 104. This case frame 105 is preferably made of an opaque, plastic material which is rigid so as to protect any product that may be placed in the closable case 104 from being crushed. It will be apparent that the case frame 105 may be made of other materials, however, including materials that are not opaque, or materials that are not rigid to prevent crushing. Because the case frame 105 preferably forms the ends 116 of the case 104, its shape will affect the shape of the case 104. For containing eyewear, the ends 116 of the case are preferably substantially oval shaped. However, it will be apparent that other shapes may be more suitable to other contents. Further embodiments may also omit the case frame 105 depicted in FIG. 1, in which case, the case 104 be of frameless or soft construction.

Still referring to FIG. 1, a flexible film is preferably wrapped around the frame 105 and, at one end, forms the closable flap 106. The film of a preferred embodiment of the present invention is made of a flexible, transparent material, and this material extends beyond the closable flap 106 portion so as to form the sides of the closable case 104. In a preferred embodiment, this transparent, flexible material is secured to the case frame 105 with pins 107 as depicted in FIG. 1 though another fastening or adhering technique may be used. The flap 106 is left free so that the case 104 may be opened and closed using the flap 106. Alternative embodiments of the present invention will include the entire closable case 104 constructed from the same material as that of the closable flap 106. Alternative embodiments will also include the closable flap 106 constructed from other materials that are less flexible, not transparent and different than that of the material constructing the closable case 104.

Also depicted in FIG. 1, a fastener 108 allows the closable case 104 to be fixed in a closed position. The fastener 108 depicted here is a snap including a male portion 110 coupled to the closable case 104 and a female portion 112 coupled to the closable flap 106. It will be apparent that the positions of the male portion 110 and the female portion 112 may be interchanged. It will also be apparent that the fastener 108 could be some other fastening device other than a snap, such as a hoop and loop fastener (e.g., Velcro). FIG. 1 depicts the closable case 104 in an open position; closing the fastener 108 by joining the male portion 110 and the female portion 112 will allow the closable case 104 to remain in a closed position and to retain any contents.

Still referring to FIG. 1, the product card 102 is shown partially detached to the closable flap 106. In a preferred embodiment of the present invention, the product card 102 includes a fastener anchor 114 that is coupled to the female portion 112 of the fastener 108, e.g., via an aperture in the card 102 and flap 106, thereby anchoring the closable flap 106 to the product card 104. Alternative embodiments may include the product card 102 being attached to the side of the closable case 104 opposite to the closable flap 106. A preferred embodiment will also include one or more additional attachment devices 120, such as an adhesive strip, or studs or rivets which extend through an aperture in the card 102 and in the case 104, to further facilitate attaching the product card 102 to case 104. As shown in FIG. 1, the additional attachment device 120 affixes the card 102 to the flap 106. Alternative embodiments will include additional attachment means and combinations of such means with or without the adhesive strip 120 and the fastener anchor 114 and with the attachment means being in different positions. Additional features of the product card 102 are discussed in connection with FIGS. 3A and 3B herein.

Figure 2A:
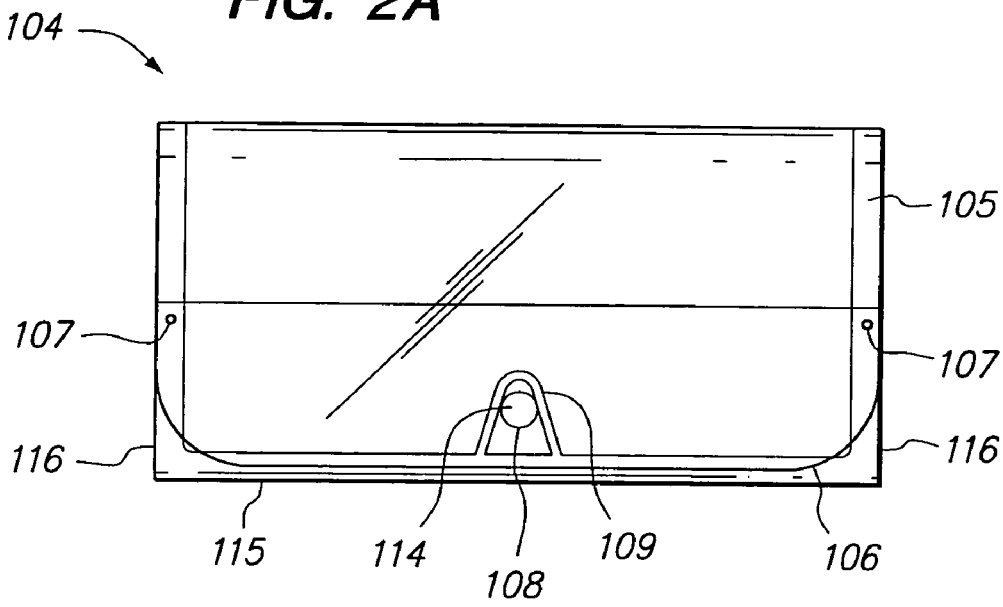
FIG. 2A illustrates a rear view of the closable case in a closed position in accordance with an embodiment of the present invention.
Figure 2B:
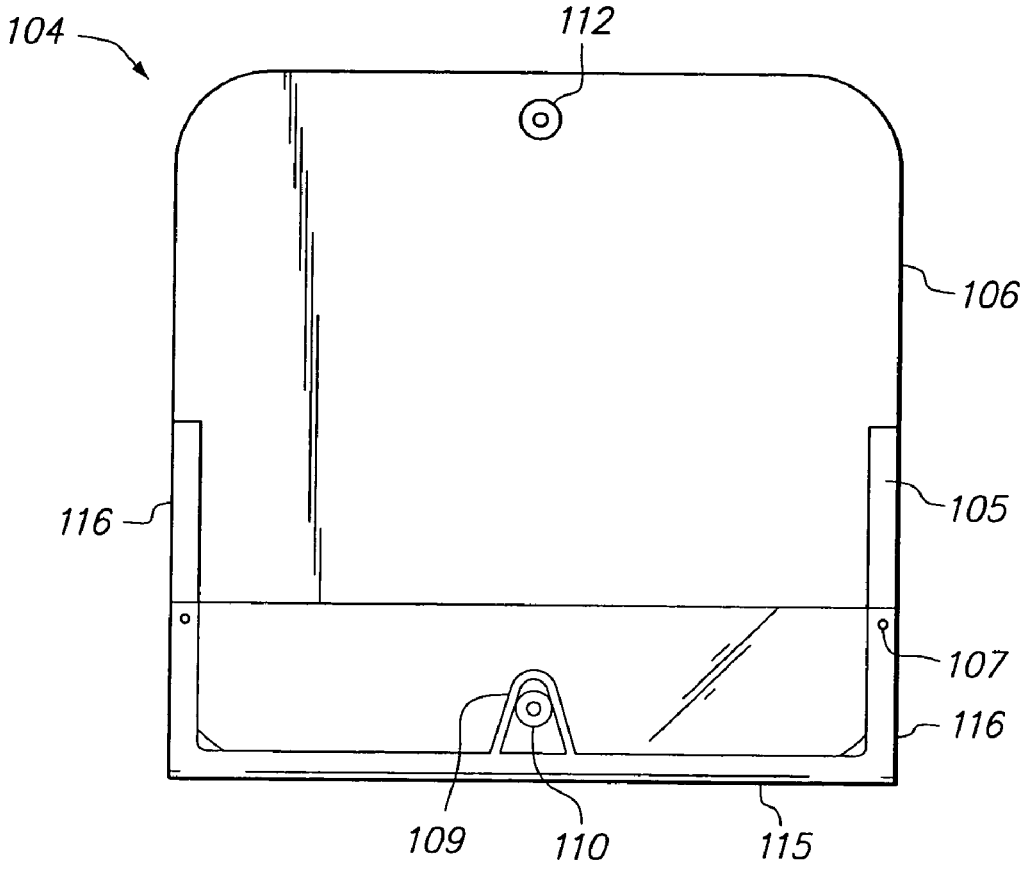
FIG. 2B illustrates a rear view of the closable case an open position in accordance with an embodiment of the present invention.

Referring now to FIGS. 2A and 2B, the closable case 104 of a preferred embodiment of the present invention is depicted as viewed from the rear of the closable case 104, i.e., facing the closable flap 106. As can be seen in this view, the case frame 105 includes a spanning member 115 for holding the end portions 116 of the frame in fixed positions with respect to one another and a nose piece 109 for preventing a product such as sunglasses or clips-on from shifting or moving within the closable case 104. Of course, alternative embodiments may not include such a nose piece 109, and as stated earlier, may not even include a case frame 105. The product card 102 (FIG. 1) is not illustrated in FIGS. 2A and 2B, so as to depict the closable case 104 separate and apart from the product card 102. The fastener 108 is shown holding the closable flap 106 in a closed position and the fastener anchor 114 coupled to the fastener 108, while being unattached from the product card 102. This operation will be discussed in greater detail below.

Referring now to FIG. 2B, the closable case 104 is depicted from the rear in an open position. The closable flap 106 is coupled to the female portion 112 of the fastener 108 while the male portion 110 of the fastener 108 is coupled to the closable case 104. As previously mentioned, the pins 107 may secure the flexible, transparent material that makes up the closable case 104 to the case frame 105.

Figure 3A:
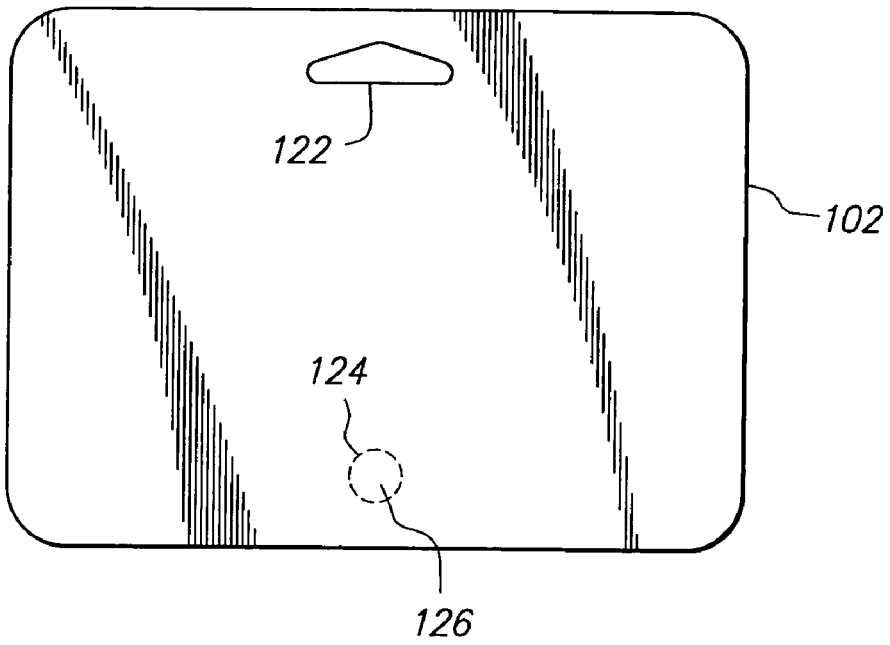
FIG. 3A illustrates a product card in accordance with an embodiment of the present invention.
Figure 3B:
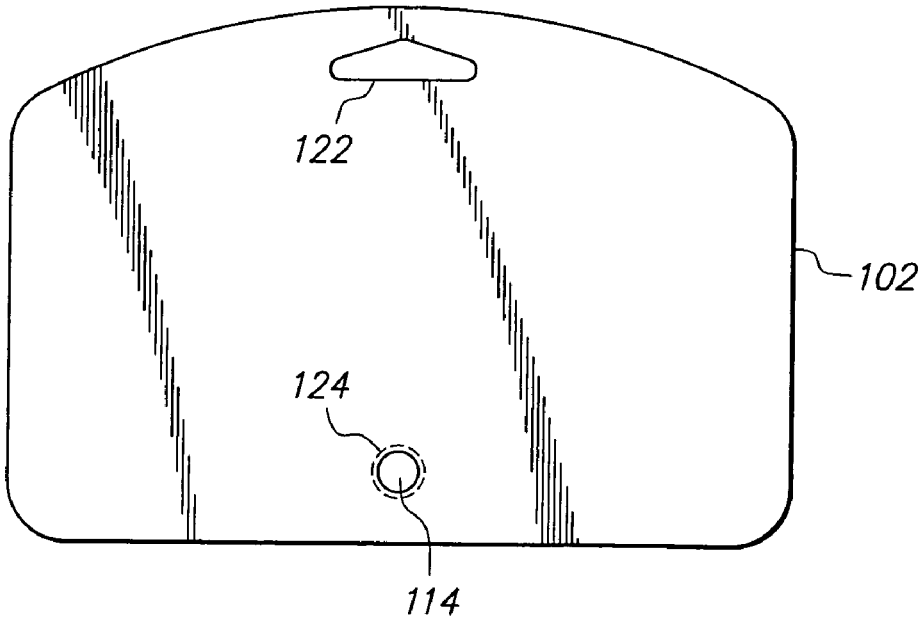
FIG. 3B illustrates a product card of in accordance with an alternate embodiment of the present invention.

Alternate embodiments of the product card 102 are illustrated in FIGS. 3A and 3B. In FIG. 3A, the product card includes an aperture 122 for hanging the product card, such as on a display stand. The aperture 122 can be of any suitable shape. It should also be noted that the product card 102 is configured for receiving printing. This may include, for example, product descriptions, trade names, trademarks, warnings, instructions, ingredients, etc., which may be printed on either side (or both sides) of the product card.

Still referring to FIG. 3A, a perforation 124 defines a detachable area 126. Preferably, the perforation 124 extends through the card 102 so that the card 102 can be easily removed, in which case, the perforation is visible from both sides of the card 102. The detachable area 126 may be of any shape and size suitable for the particular embodiment. Similarly, the card 102, itself, may be of any shape and size suitable for the particular embodiment. For example, FIG. 3A illustrates an embodiment of the card 102 that is substantially rectangular having rounded corners, while FIG. 3B shows an alternative product card 102 shape in which the uppermost side is bowed along its length.

FIG. 3B also illustrates depicts the previously described fastener anchor 114 which may be present when the product card 102 is attached to the closable case 104 (though the case 104 is not illustrated in FIG. 3B). The fastener anchor 114 is preferably coupled such that the fastener anchor 114 is wholly within the detachable area 126 of the product card 102, thereby allowing a purchaser of the product to tear the product card 102 away from the closable case 104 by simply pulling the closable case 104 and allowing the perforation 124 to release. This allows the fastener anchor 114 to stay with the closable case 104 as depicted in FIG. 2A.

Referring to FIGS. 1 and 3B, a method of the present invention includes assembling the display apparatus 100 such that the closable case 104 is removably attached to the product card 102 as described above. This may include securing the product card 102 to the closable flap 106 by coupling the fastener anchor 114 to the fastener 108. Coupling the anchor 114 to the fastener may also include forming an aperture though both the card 102 and the flap 106. The anchor fastener 114 is preferably assembled such that it is wholly contained in the detachable area 126 of the product card 102, facilitating the removal of the product card 102 from the closable case 104. Also, an attachment device 120, such as one or more adhesive strips or studs or rivets, is attached to the product card 102 for further securing of the product card 102 to the closable case 104. Alternatively, the closable case 104 may be assembled to be removably attached to the product card in other ways as combinations as discussed previously.

The present invention has been described in terms of specific embodiments incorporating details to facilitate the understanding of the principles of construction and operation of the invention. Such reference herein to specific embodiments and details thereof is not intended to limit the scope of the claims appended hereto. For example, the display apparatus may also be used to display other products. It will be apparent to those skilled in the art that modifications can be made in the embodiment chosen for illustration without departing from the spirit and scope of the invention.

What is claimed is:

1. A display apparatus, comprising:

a product card configured to receive printing;

a case having a closable flap; and a fastener having a first portion and a second portion, the first portion being coupled to a stationary portion of the case, and the second portion being coupled to a fastener anchor through apertures in the product card and the closable flap, wherein the fastener second portion and anchor are formed independently of the case.

2. The display apparatus as claimed in claim 1 wherein the case comprises a flexible film from which the closable flap is formed.

3. The display apparatus as claimed in claim 2 wherein the film is transparent.

4. The display apparatus as claimed in claim 1 wherein the case is for eyewear.

5. The display apparatus as claimed in claim 1 wherein the fastener comprises a snap.

6. The display apparatus as claimed in claim 1 wherein an area of the product card defined by a perforation is coupled to the fastener anchor such that the area defined by the perforation is removed from the product card when the product card is removed from the case.

7. The display apparatus as claimed in claim 1 wherein an area of the product card that surrounds the fastener anchor is removed when the product card is removed from the ease.

8. The display apparatus as claimed in claim 7 wherein the area of the product card removed when the product card is removed from the case is defined by a perforation that surrounds the fastener anchor.

9. The display apparatus as claimed in claim 1 wherein a portion of the product card overlaps a portion of the closable flap when the closable flap is in an open position.

10. The display apparatus as claimed in claim 1 wherein the product card remains coupled to the closable flap when the closable flap is in an open position.

11. The display apparatus as claimed in claim 1 wherein the closable flap is formed from a flexible film.

12. The display apparatus as claimed in claim 1 wherein the product card includes an additional aperture, the additional aperture configured to allow the product card to be hung for display.

13. The display apparatus as claimed in claim 1 wherein an additional attachment device is attached to the product card for further securing of the product card to the case.

14. A method of assembling a display apparatus, comprising:

assembling a case, the case having a closeable portion of the case that is closable with respect to a stationary portion of the case; and coupling a product card to the case, the case having a first portion of a fastener coupled to the stationary portion of the case and a second portion of the fastener coupled to a fastener anchor through apertures in the product card and the closable portion of the case, wherein the fastener second portion and anchor are formed independently of the case.

15. The method as claimed in claim 14 wherein the case comprises a flexible film from which the closable flap is formed.

16. The method as claimed in claim 15 wherein the film is transparent.

17. The method as claimed in claim 14 wherein the case is for eyewear.

18. The method as claimed in claim 14 wherein the fastener comprises a snap.

19. The method as claimed in claim 14 wherein the second portion of the fastener is coupled to the fastener anchor through an area of the product card defined by a perforation, such that the area defined by the perforation is removed from the product card when the product card is removed from the case.

20. The method as claimed in claim 14 wherein an area of the product card that surrounds the second portion of the fastener is removed when the product card is removed from the case.

21. The method as claimed in claim 20 wherein the area of the product card removed when the product card is removed from the case is defined by a perforation that surrounds the second portion of the fastener.

22. The method as claimed in claim 14 wherein a portion of the removable product card overlaps a portion of the closable portion of the case when the closable portion of the case is in an open position.

23. The method as claimed in claim 14 wherein the removable product card remains coupled to the closable portion of the case when the closable portion of the case is in an open position.

24. The method as claimed in claim 14 wherein the closable portion of the case comprises a flexible flap.

25. The method as claimed in claim 14 wherein the product card includes an additional aperture, the additional aperture configured to allow the product card to be hung for display.

26. The method as claimed in claim 14 wherein an additional attachment device is attached to the product card for further securing of the product card to the case.

* * * * *